US006079375A

United States Patent [19]

Duerr et al.

[11] Patent Number: 6,079,375

[45] Date of Patent: Jun. 27, 2000

[54] COOLANT JACKETED CYLINDER LINER WITH STIFFENING RIBS

[75] Inventors: Werner C. Duerr, Westchester; Edward J. Cryer, III, Lockport; Vijaya Kumar, Darien, all of Ill.

[73] Assignee: General Motors Corporation, Detroit, Mich.

[21] Appl. No.: 09/365,000

[22] Filed: Aug. 2, 1999

[51] Int. Cl.[7] ..... F02F 1/10

[52] U.S. Cl. ..... 123/41.72; 123/41.79

[58] Field of Search ..... 123/41.72, 41.79, 123/41.81, 41.74

[56] References Cited

U.S. PATENT DOCUMENTS

| | | | |
|---|---|---|---|
| 1,682,436 | 8/1928 | Sprado | 123/41.79 |
| 2,296,748 | 9/1942 | Straub | 123/173 |
| 4,093,842 | 6/1978 | Scott | 219/121 |
| 5,062,393 | 11/1991 | Smith et al. | 123/41.72 |
| 5,758,608 | 6/1998 | Berger et al. | 123/41.33 |
| 5,842,447 | 12/1998 | Krothky et al. | 123/41.28 |

*Primary Examiner*—Willis R. Wolfe
*Assistant Examiner*—Katrina B. Harris
*Attorney, Agent, or Firm*—Dean L. Ellis

[57] ABSTRACT

An engine cylinder liner includes inner and outer walls formed integral with a head seat rim and defining a coolant jacket for cooling the inner cylinder wall. Stiffening ribs are provided for strengthening the upper liner structure to withstand combustion forces between the liner and a cylinder head attached to the head seat rim. The stiffening ribs are generally triangular and extend from a low point on the outer wall upward and inward to connection with the inner wall adjacent stud bosses in the head seat rim. Thus, connection of the ribs with the inner wall is minimized and the free flow of coolant along the inner wall is maximized, thereby improving cooling of the cylinder wall and reducing wear and scuffing of the liner in service.

11 Claims, 4 Drawing Sheets

COOLANT JACKETED CYLINDER LINER WITH STIFFENING RIBS

TECHNICAL FIELD

This invention relates to coolant jacketed cylinder liners for engines, especially diesel engines, and in particular to a liner with stiffening ribs for strengthening a cylinder head seat rim without distorting an adjacent cylinder wall.

BACKGROUND OF THE INVENTION

It is known in the art to provide a coolant jacketed cylinder liner for diesel engines, and particularly for two cycle diesel engines as manufactured for use in railroad locomotives and other applications by the Electro-Motive Division of General Motors Corporation. The liner includes a ring of air inlet ports between upper and lower ends for admitting air charges into the cylinder and scavenging exhaust gases out through valves in an associated cylinder head when an associated piston is near its bottom dead center position.

Coolant jackets are provided above and below the inlet ports and are connected by passages through bridges extending longitudinally between the ports for guiding the piston and associated compression rings past the intake port area. The jackets carry coolant, which may be treated water, a mixture of water and antifreeze or any suitable fluid coolant, from an inlet in the lower jacket to the upper jacket and out through openings in a cylinder head seat rim to an associated cylinder head for carrying away excess heat from the liner, piston and cylinder head. Such liners were at an earlier period made as unitary castings with the coolant jackets integrally formed. Subsequently, the castings were modified to delete the outer jacket walls to provide better control and inspection of the internal coolant jacket passages. Steel jackets are welded around the liner to enclose the upper and lower jackets.

As the sizes of the liner bores and the power of the engines were increased, a problem developed of cracking of the cylinder wall of the liner adjacent the stud bosses in the head seat rim at the top of the liner where studs are mounted for securing the liner to a cylinder head. This problem was overcome by adding cast radial ribs in the water jacket, spaced around the top of the liner at the locations of the cylinder head stud bosses. The ribs extend downward from the cylinder head seat rim and angle radially downward from a depending outer wall, to which the upper cylinder jacket is welded, to an upper portion of the cylinder wall, which also forms the inner wall of the upper cylinder jacket. These ribs strengthened the liner cylinder wall at the stud boss locations and overcame the cracking problem.

SUMMARY OF THE INVENTION

The present invention provides a new cylinder liner which abandons the welded on coolant jacket sleeves of the prior design and again makes use of the earlier concept of a liner with fully cast inner and outer walls. This development is now possible because of improvements in casting technology which allow internal passages of the coolant jacket to by formed more accurately than before and avoid the need for the fabricated construction using separate welded on liner sleeves. In development of the new liner, it was found that the ribs which strengthen the cylinder wall to avoid cracking also interfere with cooling of the wall adjacent the stud bosses. This can cause distortion of the cylinder bore which, under high thermal loading of the cylinder, may adversely affect cylinder wear and scuffing.

Thorough study and testing have resulted in a new form of strengthening ribs in the liner. These take advantage of the liner outer wall to provide support for the ribs needed to strengthen the stud boss locations in the head seat rim so that stresses in the adjacent inner wall or cylinder wall of the liner do not result in cracking problems. The new arrangement minimizes contact of the ribs with the inner cylinder wall, thus improving coolant flow around the upper cylinder wall and reducing upper cylinder wall distortion.

A feature of the invention is that stiffening ribs connect the head seat rim and the outer wall for stiffening the liner structure at its upper end. The ribs are angled upward and inward from a low point on the outer wall to a connection with the inner wall adjacent the head seat rim so that connection of the ribs with the inner wall is minimized and freedom of coolant to flow against the inner wall near its upper end for cooling the inner wall is maximized.

To avoid local stresses, the rib upper ends are faired smoothly into the cylinder wall adjacent the stud boss. The result is generally triangular ribs which stiffen the adjoining structures of the head seat rim and the depending outer wall while maintaining limited direct connection to the cylinder wall. Thus, the upper coolant jacket is opened to flow around the upper end of the cylinder wall radially inward of the ribs which are angled away from contact with the cylinder wall. Improved cooling of the upper cylinder wall is thus provided with the expected result of extended cylinder wear and reduced scuffing.

These and other features and advantages of the invention will be more fully understood from the following description of certain specific embodiments of the invention taken together with the accompanying drawings.

DESCRIPTION OF THE PREFERRED EMBODIMENT

Figure 1:
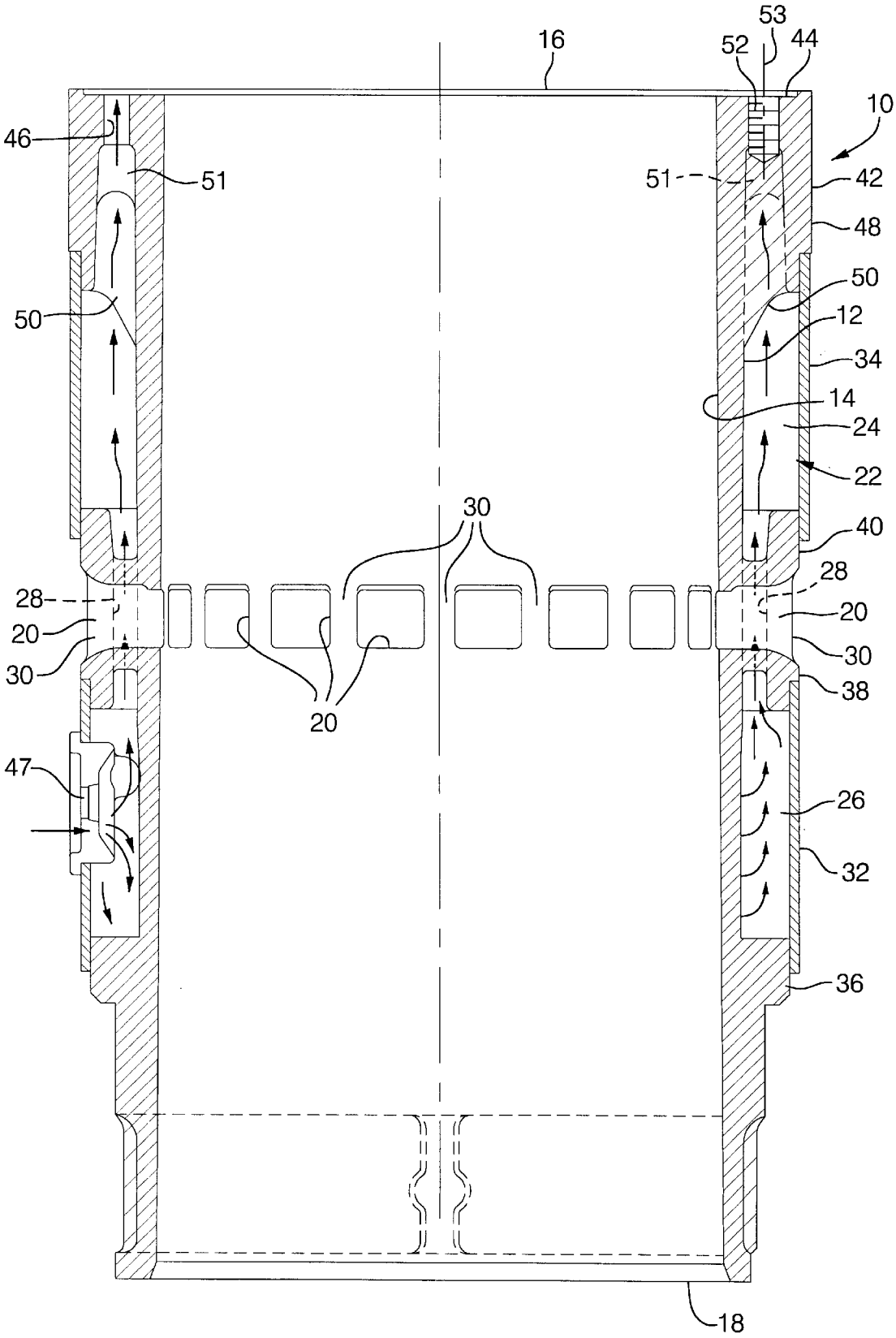
PRIOR ART FIG. 1
FIG. 1 is an axial cross-sectional view of a prior model engine cylinder liner with fabricated coolant jacket sleeves and stiffening ribs in the jacket adjacent the head seat rim.

Referring first to FIG. 1 of the drawings, numeral 10 generally indicates a prior art cylinder liner for use in a known two-stroke cycle diesel engine. Liner 10 includes an inner wall 12 internally defining a cylinder 14 in which a piston, not shown, is received for reciprocable motion therein. Between its upper and lower ends 16, 18, liner 10 includes a plurality of inlet ports 20 for admitting scavenging and charging air to the cylinder during engine operation.

Outwardly of the cylinder inner wall 12 there is formed a coolant jacket 22 having upper and lower portions 24, 26 located respectively above and below the inlet ports 20. Coolant passages 28 extend through struts 30 which separate the ports 20. Passages 28 conduct coolant between the upper and lower portions of the coolant jacket 22. Steel sleeves 32, 34 welded to protrusions 36, 38, 40, 42 from the inner wall 12 define outer portions of the coolant jacket which is defined at its upper end by a head seat rim 44. Passages 46 in the head seat rim 44 connect the upper coolant jacket with passages in a cylinder head, not shown, for conducting coolant into the associated cylinder head when mounted on the head seat rim 44 of the liner.

An inlet connection 47 to the lower portion 26 of the coolant jacket conducts coolant to the liner for cooling the cylinder wall 12. The upper protrusion 42 is formed as an outwardly and downwardly extending wall portion of the head seat rim 44. This wall portion includes a cylindrical guide surface 48 which locates the upper end of the liner in an engine.

Protrusion 42 is connected to the inner cylinder wall at annularly spaced locations by a plurality of ribs 50 which stiffen the upper end of the cylinder liner. The ribs are located in alignment with stud bosses 51 which include threaded bores 52 formed on parallel axes 53 to receive studs, not shown, for securing an associated cylinder head to the cylinder head seat rim. The ribs 50 extend from the lower end of the upper protrusion or wall 42 diagonally downward and inward to the cylinder inner wall 12. Ribs 50 stiffen the upper cylinder structure to withstand stresses occurring adjacent the stud bosses by combustion pressures developed within the cylinder during engine operation.

The sectional view of liner 10 is such that the right side of the illustration is through one of the stud bosses 51 and ribs 50 while the left side of the illustration is through a coolant passage 46 from the upper jacket and shows one of the stud bosses 51 and one of the ribs 50 in the background.

Figure 2:
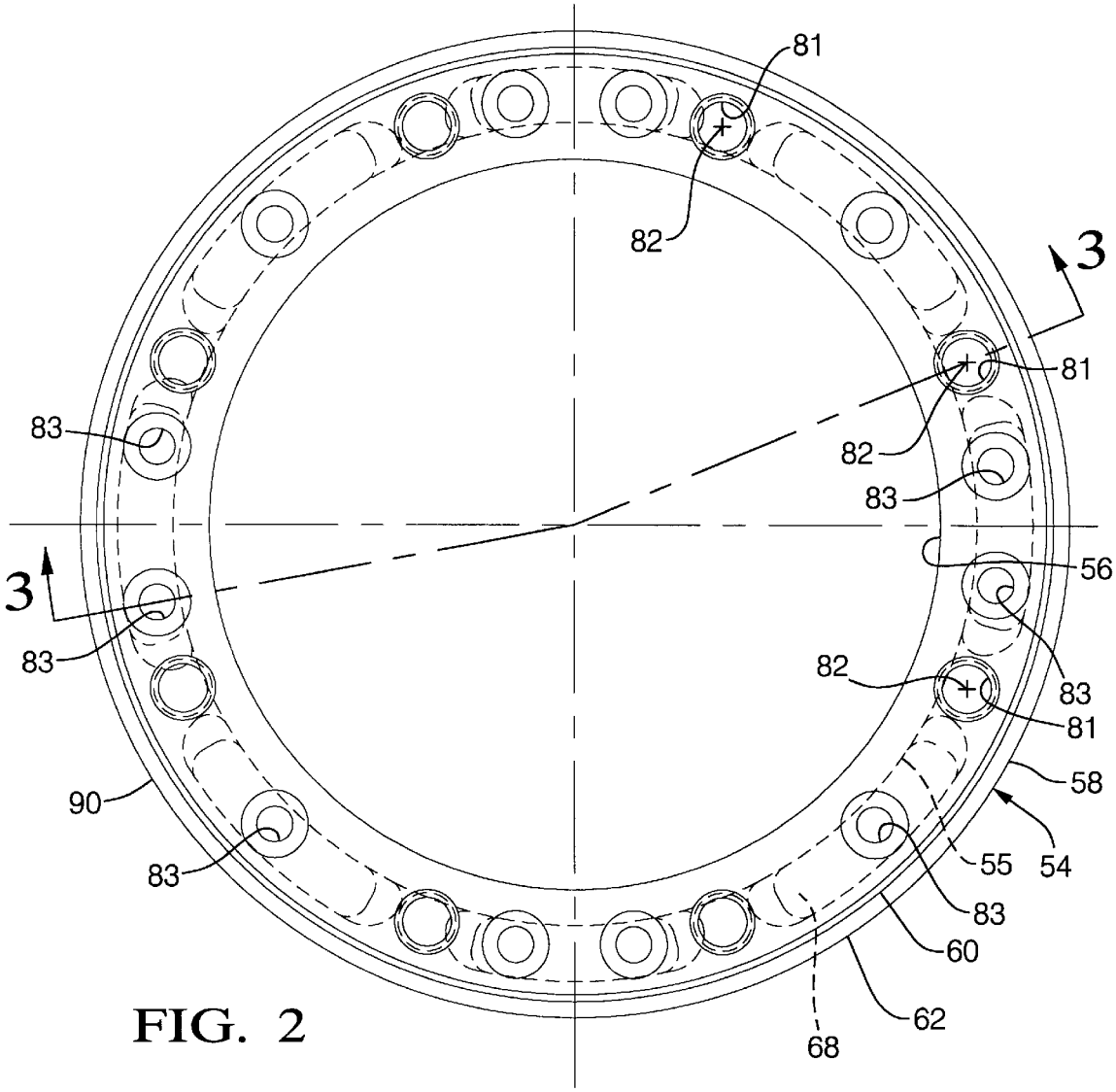
FIG. 2 is an upper end view of fully cast cylinder liner having modified structure and stiffening ribs according to the invention.
Figure 4:
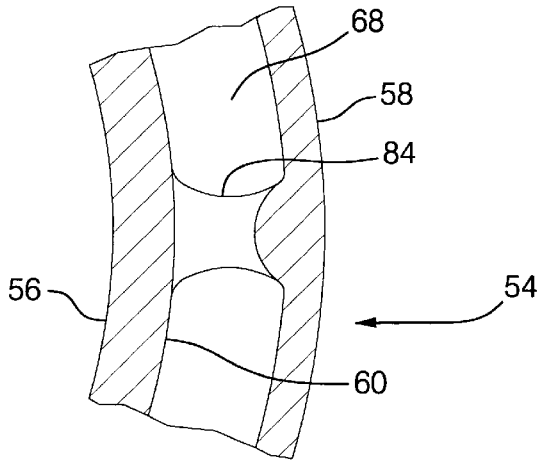
FIG. 4 is a cross-sectional view upward from the line 4—4 of FIG. 3.
Figure 3:
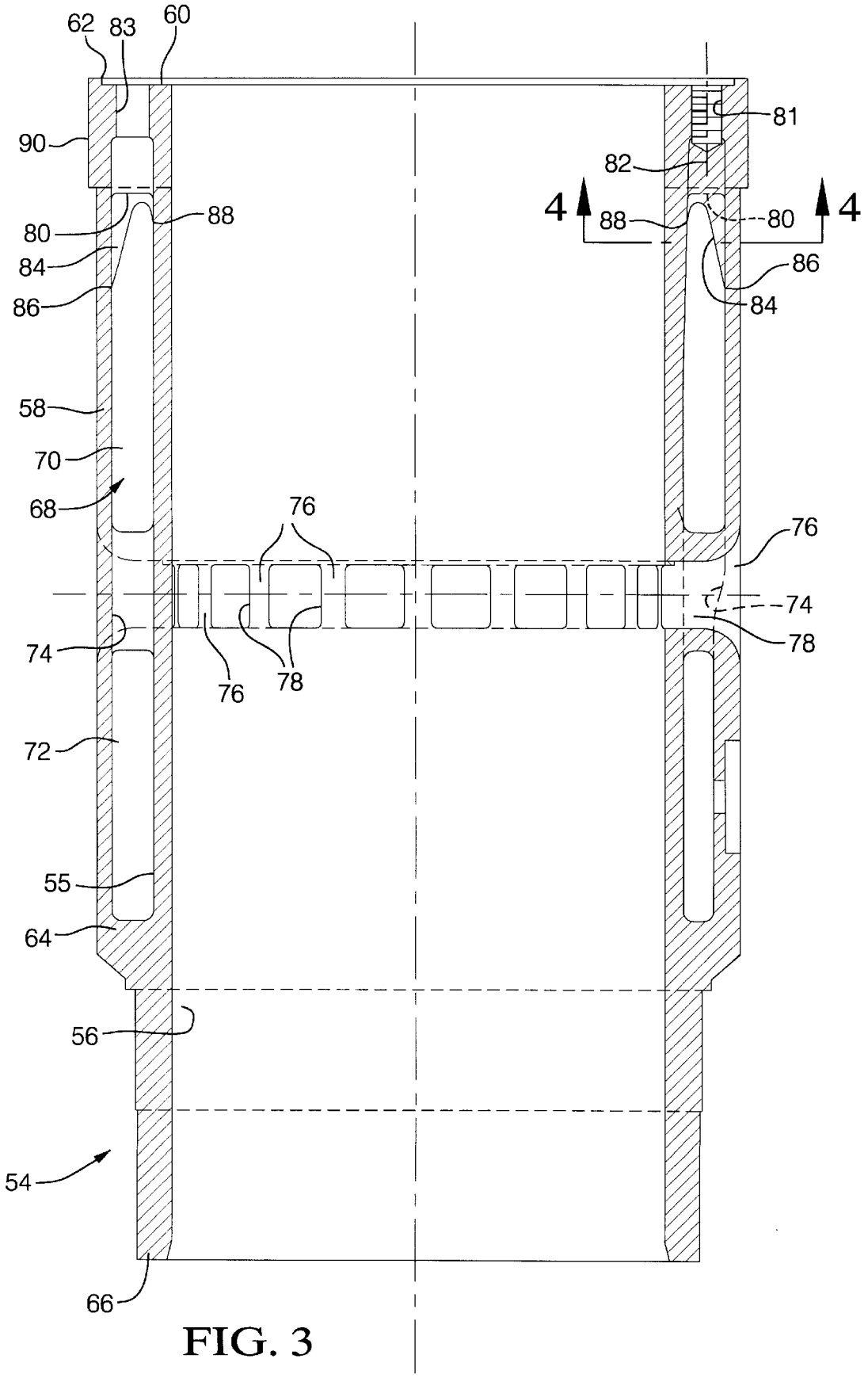
FIG. 3 is an axial cross-sectional view similar to FIG. 1 but taken from the planes of the line 3—3 of FIG. 2.

Referring now to FIGS. 2–4 of the drawings, there is shown an engine cylinder liner according to the invention and generally indicated by numeral 54. Liner 54 is an integrally cast member having a cylinder inner wall 55 that defines internally a cylinder 56. The inner wall 55 is integrally joined with a cast outer wall 58 by a head seat rim 60 located at an upper end 62 of the liner and interconnecting upper ends of the inner and outer walls. A lower end 64 of the outer wall is connected to the inner wall 55 at a point above a lower end 66 of the liner. Between the ends, the inner and outer walls and the head seat rim define a coolant jacket 68 having upper and lower portions 70, 72 connected by passages 74 extending through annularly spaced struts 76. These struts separate a plurality of air inlet ports 78 disposed intermediate the ends of the liner and extending through the inner walls for admitting scavenging and charging air to the cylinder during engine operation. The head seat rim 60 defines the upper end of the coolant jacket and includes a plurality of spaced stud bosses 80 that extend downward into the upper portion of the upper coolant jacket. The stud bosses 80 include threaded bores 81 formed on parallel axes 82. The bores 81 receive studs, not shown, for securing an associated cylinder head on the head seat rim 60. The stud bosses 80 are annularly alternately spaced between coolant passages 83 extending through the head seat rim for connecting the upper coolant jacket with an associated cylinder head.

In order to stiffen the structure of the upper portion of the cylinder liner to withstand the stresses imposed by combustion loads and clamping pressures between the cylinder head and liner, liner 54 is provided with stiffening ribs 84. Unlike the ribs of the prior art liner, ribs 84 extend primarily between the outer wall 58 and the associated stud bosses 80 and have only a minimum of connection with the inner wall 55. In particular, ribs 84 extend from a point 86 on the outer wall diagonally upwardly to a connection 88 with the inner wall immediately adjacent the lower end of the associated stud boss 80. The connection 88 of the rib 84 with the inner wall has a small radius to minimize stresses at the junction of these elements.

By reason of the revised structure of liner 52, the strength of the outer wall 58 is combined with that of the head seat rim 60 to provide the structural strength necessary to withstand the head-to-cylinder stresses. At the same time, the surface of the inner wall is essentially devoid of connection with the ribs and thus is fully contacted by coolant within the upper coolant jacket portion 70 so that cooling in the upper cylinder liner is improved, wall temperatures are reduced and scuffing and wear of the cylinder liner are avoided or reduced during operation of the engine.

A cylindrical guide surface 90 is provided by an outwardly extended portion of the head seat rim 60 and extends downward from the upper end to a point near the lower end of the stud bosses 80. Guide surface 90 is provided to locate the cylinder liner within an engine crankcase.

Figure 5:
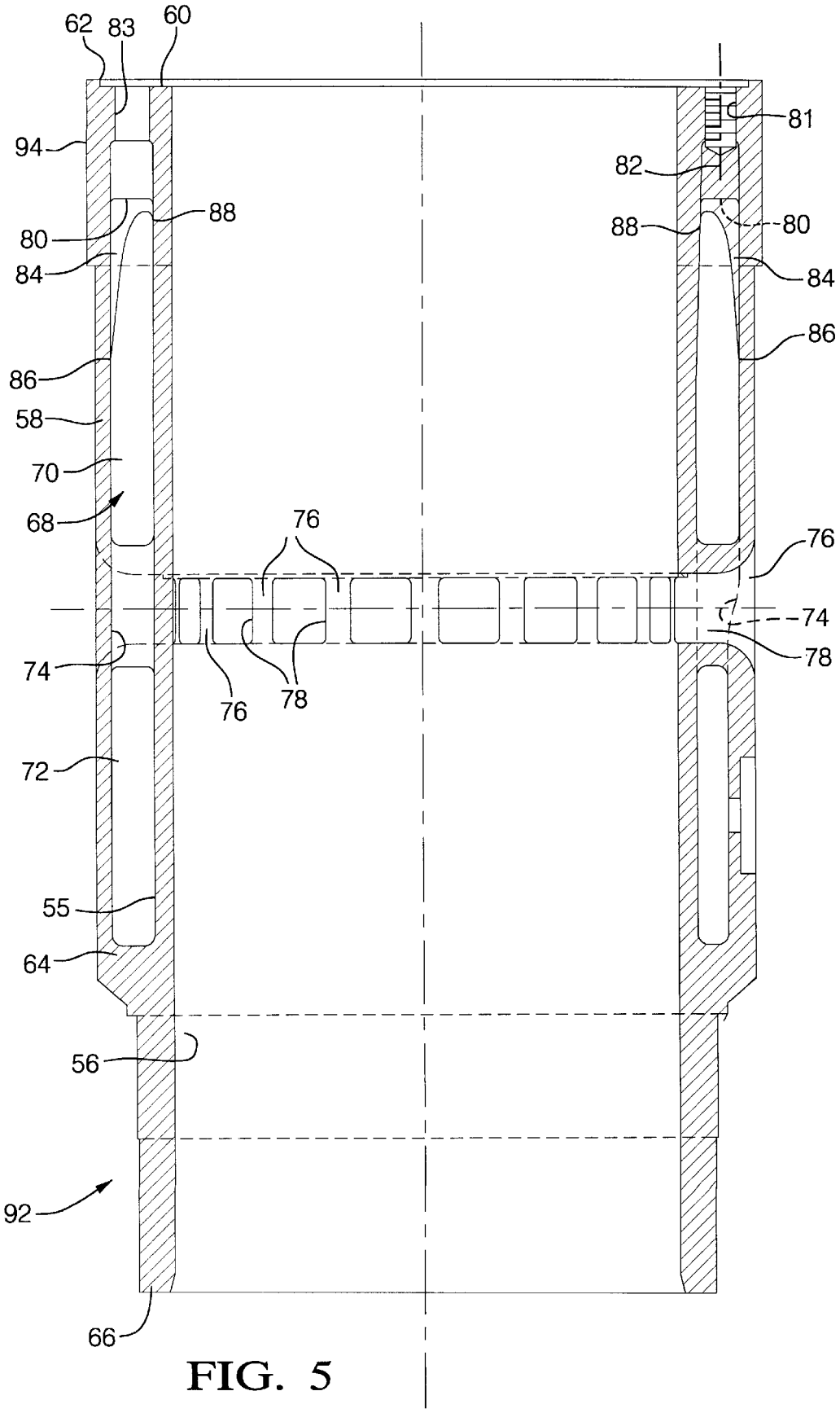
FIG. 5 is a cross-sectional view similar to FIG. 3 but showing a modified embodiment of cylinder liner.

Referring now to FIG. 5 of the drawings, there is shown an alternative embodiment of cylinder liner 92 formed in accordance with the invention. The fundamental features of cylinder liner 92 are identical with those of liner 54 so that like numerals are used for like or similar features. Liner 92 differs in that its length is increased over that of liner 52 and an annular guide surface 94 is provided which is longer than surface 90 of liner 52. As a result, guide surface 94 extends downwardly on the outer wall 58 of the liner to a point substantially below the lower ends of the stud bosses 80 of cylinder liner 92. In other respects, the structures of liners 54 and 92 are alike, including the stiffening ribs 84 which provide a function of stiffening the upper liner structure as previously described. Accordingly, further discussion of the alternative longer liner embodiment is believed unnecessary.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. An engine cylinder liner having radially spaced inner and outer walls internally defining a coolant jacket defined at an upper end by a head seat rim extending between upper ends of said walls and adapted for receiving a cylinder head, the inner wall internally defining a cylinder adapted to be closed by the cylinder head and to receive a piston for reciprocable motion in the cylinder, the coolant jacket adapted to conduct liquid coolant therethrough for cooling the cylinder inner wall, characterized by:

stiffening ribs connecting the head seat rim and the outer wall for stiffening the liner structure at its upper end, the ribs being angled upward and inward from a low point on the outer wall to a connection with the inner wall adjacent the head seat rim so that connection of the ribs with the inner wall is minimized and freedom of coolant to flow against the inner wall near its upper end for cooling the inner wall is maximized.

2. An engine cylinder liner as in claim 1 wherein the head seat rim includes a plurality of annularly spaced stud bosses extending slightly downward into the coolant jacket and including upwardly opening stud bores adapted for receiving studs for securing a cylinder head to the head seat rim, said stiffening ribs being connected with said stud bosses.

3. An engine cylinder liner as in claim 2 wherein said head seat rim includes coolant openings connecting the coolant jacket with an upper end of the liner for conducting coolant between the coolant jacket and an associated cylinder head secured to the head seat rim.

4. An engine cylinder liner as in claim 3 wherein said stud bores are annularly spaced on parallel stud axes and said ribs are axially aligned with said stud axes.

5. An engine cylinder liner as in claim 1 wherein said cylinder liner includes a plurality of annularly spaced air inlet ports intermediate upper and lower ends of the liner and extending through the inner and outer walls for admitting scavenging air to the cylinder, said coolant jacket including upper and lower jacket portions respectively above and below said ports and connected by passages through ribs annularly spaced between the ports, and inlet means communicating with said lower jacket portion for conducting coolant to the lower jacket portion for passage through the jacket to a cylinder head for cooling the liner cylinder inner wall.

6. An engine cylinder liner as in claim 2 and including a thickened portion of the outer wall forming an outwardly protruding annular guide surface extending downward from the upper end of the liner.

7. An engine cylinder liner as in claim 6 wherein the guide surface terminates near lower ends of the stud bosses.

8. An engine cylinder liner as in claim 6 wherein the guide surface extends substantially below the lower ends of the stud bosses.

9. An engine cylinder liner as in claim 1 wherein said ribs are generally triangular.

10. An engine cylinder liner as in claim 9 wherein said ribs extend radially within the coolant jacket.

11. An engine cylinder liner as in claim 1 wherein the inner and outer walls are cast integrally with the head seat rim.

* * * * *